US006431813B2

(12) United States Patent
Sugaya et al.

(10) Patent No.: US 6,431,813 B2
(45) Date of Patent: Aug. 13, 2002

(54) UNWRAPPING APPARATUS

(75) Inventors: Fumio Sugaya; Yoichi Endo; Akihiro Komatsu; Tomoyuki Takiue, all of Kanagawa-ken (JP)

(73) Assignee: Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/810,610

(22) Filed: Mar. 19, 2001

(30) Foreign Application Priority Data

Mar. 17, 2000 (JP) ..... 2000-076625

(51) Int. Cl.[7] ..... B67B 7/68; B65B 69/00

(52) U.S. Cl. ..... 414/412; 414/411; 414/403; 53/381

(58) Field of Search ..... 414/411, 412, 414/416.07, 403; 83/912; 53/381

(56) References Cited

U.S. PATENT DOCUMENTS 4,571,140 A * 2/1986 Yamada et al. ..... 414/411
5,055,869 A * 10/1991 DiPietro ..... 206/455
5,237,910 A * 8/1993 Chigira ..... 222/238

FOREIGN PATENT DOCUMENTS

JP 9-237383 9/1997 ..... G07F/13/06

* cited by examiner

*Primary Examiner*—Eileen D. Lillis
*Assistant Examiner*—Charles A Fox
(74) *Attorney, Agent, or Firm*—Sughrue Mion, PLLC

(57) ABSTRACT

An unwrapping apparatus unwraps a slide pack wrapped with a wrapping sheet to obtain a slide contained therein. As paired rollers forward the slide pack, a squeezing member squeezes the slide backward within an unsealed space in the slide pack to form a wide cut allowance at the front edge of the slide pack. After the slide reaches the rear end of the unsealed space, nip pressure applied to the slide pack by the paired rollers is reduced to further forward the slide pack to a predetermined position. At the predetermined position, a cutter partially cuts the cut allowance to form a slit thereon. Then, the slide pack is transferred back by the paired rollers under a raised nip pressure which is sufficient to squeeze the slide out from the slit. Accordingly, the slide will be gradually separated from the wrapping sheet.

19 Claims, 26 Drawing Sheets

FIG.6A
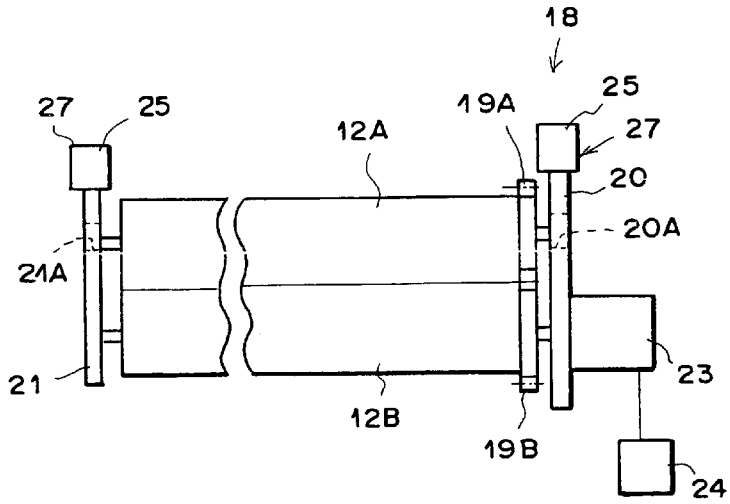
FIG.6B
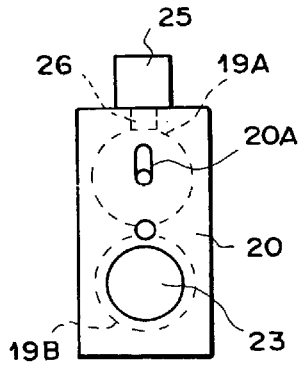
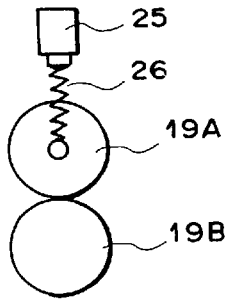
FIG.6C
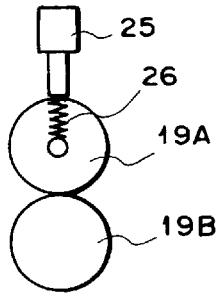
FIG.6D

UNWRAPPING APPARATUS

BACKGROUND OF THE INVENTION

1. Field of the Invention

The present invention relates to an unwrapping apparatus for unwrapping a package wrapped with a wrapping sheet to obtain a solid object wrapped therein.

2. Description of the Related Art

Heretofore, there has been a widely used dry-type slide for chemical analysis (hereinafter, referred to simply as a "slide"). Such a slide may be used for quantitative analysis of a chemical component or a material component of a liquid sample dripped thereon. More specifically, the quantitative analysis may be carried out by dripping a drop of the liquid sample on the slide, putting the slide in an incubator for a predetermined time to promote color reaction (i.e., color matter producing reaction) of the liquid sample, irradiating the slide with radiation including a predetermined wavelength to measure optical density of a target biochemical substance contained in the liquid sample, and determining physical density of the target biochemical substance based on the measured optical density referring to a predetermined working curve correlating the optical density of the biochemical substance with the physical density thereof. The predetermined wavelength included in the radiation is determined depending on the combination of the target biochemical substance contained in the liquid sample and a reagent mixed in a material of the slide. The entire process described above is carried out by a suitably configured biochemical analyzer.

The biochemical analyzer used for the above quantitative analysis has a slide stocking portion which holds a plurality of slides ready for the analysis. Usually, when shipping the slides, each slide is wrapped tightly with a plastic film laminated with a metal lamina or a plurality of slides are packed in a single tightly-wrapped cartridge. In each case, an unwrapped slide must be used immediately or stocked in a dry atmosphere, as the reagent mixed in the material of the slide deteriorates rapidly. Therefore, it is desirable to use a plurality of individually-wrapped slides when there is a need to analyze many slides. However, in such a case, preparation for the analysis will require a lot of effort if the examiner has to manually unwrap each slide.

To reduce the problem, there have been several known apparatuses for unwrapping a package wrapped with a wrapping sheet such as a wrapping film to obtain a solid object wrapped therein. One example of such apparatuses is disclosed in Japanese Unexamined Patent Publication No. 9(1997)-237383. The apparatus disclosed in the Publication is directed to unwrapping a belt-like package containing a series of sub-packs each containing beverage ingredients therein. The sub-packs are tightly sandwiched between an upper wrapping sheet and a lower wrapping sheet. Although the disclosed apparatus is capable of unwrapping the belt-like package by peeling off the upper wrapping sheet from the lower wrapping sheet to obtain the sub-packs therein, the examiner is still required to manually detach edges of the upper and lower wrapping sheets in advance. Thus, the disclosed apparatus is incapable of unwrapping the individually wrapped slides.

SUMMARY OF THE INVENTION

An object of the present invention is to provide an unwrapping apparatus capable of automatically unwrapping a package containing a solid object such as the slide described above wrapped with a wrapping sheet.

According to the first aspect of the present invention, there is provided an unwrapping apparatus for unwrapping a package containing a solid object tightly wrapped with a wrapping sheet, the package including an unsealed space where the solid object is contained and a sealed portion surrounding the unsealed space, comprising: paired rollers rotatable so that the package caught between the paired rollers is transferred along a predetermined transferring path; a cutter located behind the paired rollers along the transferring path for making a slit on the unsealed space at a position near the front edge of the package; and controlling means for controlling operations of the paired rollers and the cutter by setting nip pressure applied to the package by the paired rollers at a pressure suitable both for transferring the package containing the solid object and for transferring the wrapping sheet without the solid object, rotating the paired rollers in respective predetermined directions so that the package is forwarded along the predetermined transferring path, terminating rotation of the paired rollers when the rear edge of the package comes between the paired rollers, making a slit on the package, and rotating the paired rollers in the directions opposite to the predetermined directions so that only the wrapping sheet separated from the solid object is transferred back by the paired rollers.

When using the above unwrapping apparatus according to the first aspect of the present invention, the rotation of the paired rollers is terminated when the rear edge of the package comes between the paired rollers after the paired rollers have run on a portion of the package where the solid object resides. Then, the paired rollers are rotated in the opposite directions after the slit is formed on the package. Now, the solid object within the package cannot be held between the paired rollers and thus cannot be transferred backward. Thus, only the wrapping sheet is transferred back to the area in front of the paired rollers. Therefore, the solid object within the package is gradually squeezed out from the slit formed on the package, and the solid object is separated from the wrapping sheet. That is to say, the unwrapping apparatus according to the first aspect of the present invention automatically unwraps the package to separate the solid object therein from the wrapping sheet. In addition, as the wrapping sheet separated from the solid object is pressed between the paired rollers while being transferred backward, the bulk of the removed wrapping sheet is reduced to facilitate handling thereof.

According to the second aspect of the present invention, there is provided an unwrapping apparatus for unwrapping a package containing a solid object tightly wrapped with a wrapping sheet, the package including an unsealed space where the solid object is contained and a sealed portion surrounding the unsealed space, comprising: paired rollers rotatable so that the package caught between the paired rollers is transferred along a predetermined transferring path; nip pressure altering means for altering nip pressure applied to the package by the paired rollers; a cutter located behind the paired rollers along the transferring path for making a slit on the unsealed space at a position near the front edge of the package; and controlling means for controlling operations of the paired rollers, the nip pressure altering means and the cutter by setting the nip pressure applied by the paired rollers at a first nip pressure, rotating the paired rollers in respective predetermined directions so that the package is forwarded along the predetermined transferring path, terminating rotation of the paired rollers when the rear edge of the package comes between the paired rollers, making a slit on the package, setting the nip pressure applied by the paired roller at a second nip pressure which is larger than the first nip pressure, and rotating the paired roller in the directions opposite to the predetermined directions so that only the wrapping sheet separated from the solid object is transferred back by the paired rollers.

The term "the front edge of the package" refers to the edge at the head of the package while being forwarded along the transferring path by the paired rollers rotating in the above predetermined directions. On the other hand, the term "the rear edge of the package" refers to the edge at the tail of the package while being forwarded by the paired rollers rotating in the above predetermined directions.

The term "a first nip pressure" refers to a relatively low nip pressure enabling the paired rollers to run on the portion of the package where the solid object resides. On the other hand, the term "a second nip pressure" refers to a relatively high nip pressure preventing the paired rollers from running on the portion of the package where the solid object resides therein. That is to say, the solid object in the package is squeezed back within the unsealed space in the package when the second nip pressure is applied by the paired rollers.

When using the above unwrapping apparatus according to the second aspect of the present invention, the rotation of the paired rollers is terminated when the rear edge of the package comes between the paired rollers after the paired rollers under the first nip pressure have run on the portion of the package where the solid object resides. Then, the paired rollers, which are now set at the second nip pressure, are rotated in the opposite directions after the slit is formed on the package. Accordingly, as the solid object within the package cannot be held between the paired rollers and thus cannot be transferred backward, only the wrapping sheet is transferred back to the area in front of the paired rollers. Therefore, the solid object within the package is gradually squeezed out from the slit formed on the package, and the solid object is separated from the wrapping sheet. That is to say, the unwrapping apparatus according to the second aspect of the present invention automatically unwraps the package to separate the solid object therein from the wrapping sheet. In addition, as the wrapping sheet separated from the solid object is pressed between the paired rollers while being transferred backward, the bulk of the removed wrapping sheet is reduced to facilitate handling thereof.

It is desirable that the unwrapping apparatus according to the second aspect of the present invention further comprises shift detecting means for recognizing that the solid object has been sufficiently squeezed back to the rear end of the unsealed space in the package; wherein the controlling means further controls operations of the paired rollers, the nip pressure altering means and the shift detecting means by setting the nip pressure applied by the paired rollers at a third nip pressure which is larger than the first nip pressure before setting the nip pressure at the first nip pressure, rotating the paired rollers in the predetermined directions so that the package is forwarded along the predetermined transferring path, and changing the nip pressure applied by the paired rollers to the first nip pressure when the shift detecting means recognizes that the solid object has been sufficiently squeezed back to the rear end of the unsealed space in the package.

The term "a third nip pressure" refers to another relatively high nip pressure preventing the paired rollers from running on the portion of the package where the solid object resides. That is to say, the solid object in the package is squeezed back within the unsealed space in the package when the third nip pressure is applied by the paired rollers. The third nip pressure may be the same pressure as the second nip pressure described above.

In the above case where the unwrapping apparatus further comprises the shift detecting means, the paired rollers first forward the package with the third nip pressure which is larger than the first nip pressure. Accordingly, the solid object is squeezed back by the paired rollers within the unsealed space in the package. Once the shift detecting means recognizes that the solid object has been sufficiently squeezed back to the rear end of the unsealed space, the nip pressure applied by the paired rollers will be changed to the first nip pressure which enables the paired rollers to run on the portion of the package where the solid object resides. The forwarding operation of the paired rollers will be terminated when the rear edge of the package comes between the paired rollers. As the solid object has already been squeezed back to the rear end of the unsealed space, a relatively wide cut allowance can be obtained at the front edge of the package. Therefore, the unwrapping apparatus with the shift detecting means realizes a safer and easier cutting operation.

In addition, it is desirable that the unwrapping apparatus according to the second aspect of the present invention further comprises a squeezing member located in front of the paired rollers along the transferring path in such a manner that the squeezing member can be freely inserted into and retracted from the transferring path; wherein the controlling means further controls an operation of the squeezing member by inserting the squeezing member into the transferring path before forwarding the package under the third nip pressure, and retracting the squeezing member from the transferring path when the shift detecting means recognizes that the solid object has been sufficiently squeezed back to the rear end of the unsealed space of the package. In this case, the dedicated squeezing member located in front of the paired rollers squeezes the solid object backward as the paired rollers forward the package with the third nip pressure. Therefore, the solid object can be reliably squeezed back to the rear end of the unsealed space to form a wide cut allowance at the front edge of the package, even if the solid object is relatively thin, by using a suitably structured squeezing member.

Further, it is desirable that the unwrapping apparatus according to the second aspect of the present invention further comprises edge detecting means for detecting the front edge of the package located in front of the paired rollers along the transferring path; wherein the controlling means further controls operations of the paired rollers by causing the paired rollers to begin the rotation in the predetermined directions after the front edge of the package is detected by the edge detecting means. Such a configuration is effective in reducing power consumption, as the rotation of the paired rollers is activated after the edge detecting means detects the front edge of the package and is suspended during the cutting operation.

In addition, it is desirable that the unwrapping apparatus according to the second aspect of the present invention further comprises an object cartridge which is used for housing the solid object after being separated from the wrapping sheet and which is located behind the paired rollers along the transferring path. Such an object cartridge facilitates handling of the unwrapped solid object. The use of the object cartridge is especially effective when the solid object is a slide for chemical analysis as described above, as a plurality of unwrapped slides housed in a desired order in the object cartridge may be mounted directly on a biochemical analyzer.

Further, it is desirable that the unwrapping apparatus according to the second aspect of the present invention further comprises a disposal bin which is used for temporarily storing the wrapping sheet removed from the solid object and which is located in front of the paired rollers along the transferring path. Such a disposal bin facilitates handling of the removed wrapping sheet to be discarded.

In addition, it is desirable that the slit formed by the cutter is shorter than the entire width of the package. Such a form of the slit, which prevents the wrapping sheet from splitting in two, also facilitates handling of the removed wrapping sheet to be discarded.

BRIEF DESCRIPTION OF THE DRAWINGS

FIGS. 6A to 6D illustrate the structure of a roller unit.

DESCRIPTION OF THE PREFERRED EMBODIMENTS

Now, specific embodiments of the present invention will be described with reference to the accompanying drawings.

Figure 1:
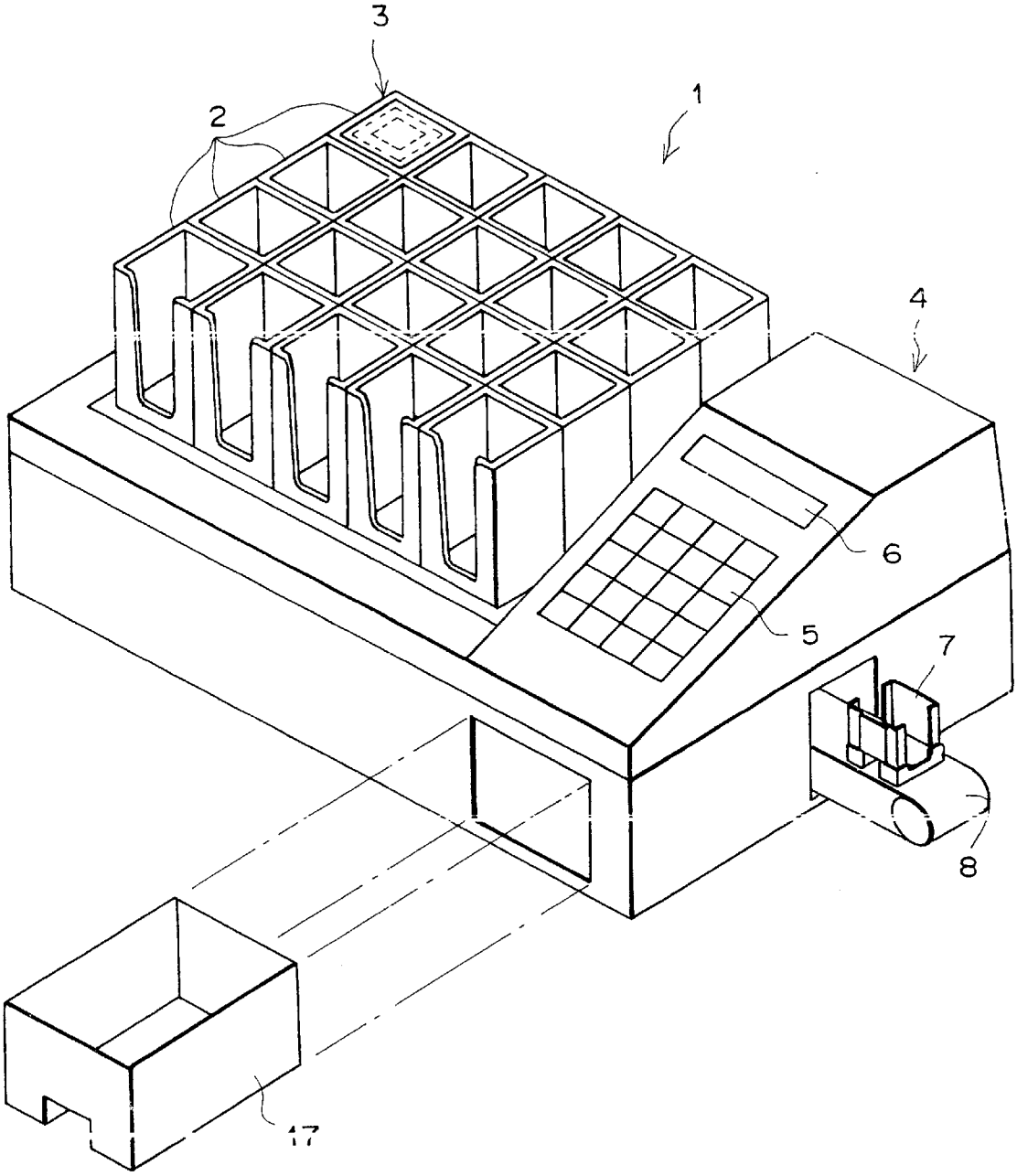
FIG. 1 is a perspective view of a selective unwrapping apparatus including an unwrapping apparatus according to the first embodiment of the present invention.
Figure 2:
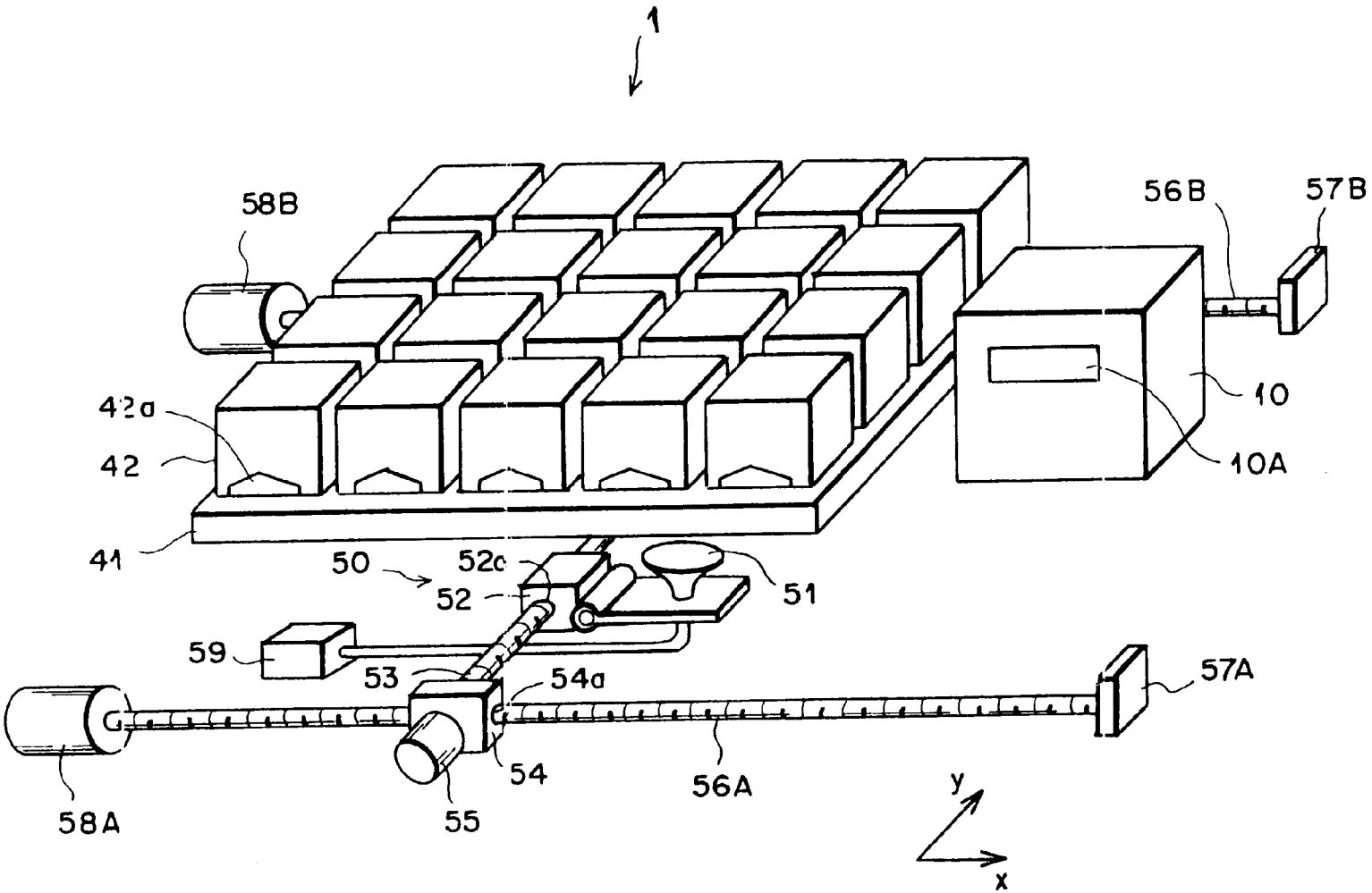
FIG. 2 is another perspective view showing an internal structure of the selective unwrapping apparatus shown in FIG. 1.

FIG. 1 is a perspective view of a selective unwrapping apparatus including an unwrapping apparatus according to the first embodiment of the present invention, and FIG. 2 is another perspective view showing an internal structure of the selective unwrapping apparatus shown in FIG. 1. The selective unwrapping apparatus 1 is directed to selecting and unwrapping a slide pack containing a dry-type slide used for chemical analysis carried out by a biochemical analyzer. In the present embodiment, the selective unwrapping apparatus comprises a housing portion 3 including a plurality of package cartridges 2 each provided for stocking slide packs each corresponding to certain analysis, and an interface 4 for inputting a command on selection of the slide pack. The interface 4 includes command keys 5 for inputting the command and a display portion 6 for displaying the content of the command for confirmation. An unwrapping apparatus 10 according to the present embodiment is provided in an internal area below the interface 4. A conveyer belt 8 is located near the unwrapping apparatus 10, wherein the conveyer belt 8 is driven by a motor not shown in the Figures. The conveyer belt 8 provided within the selective unwrapping apparatus 1 carries a cartridge 7 for housing in a desired order a plurality of slides obtained from the slide packs unwrapped by the unwrapping apparatus 10. Also provided in the internal area below the interface 4 is a disposal bin 17 which is used for temporarily storing the wrapping sheet removed from the slide and which can be freely removed from and re-attached to the selective unwrapping apparatus 1. The slide pack is fed to the unwrapping apparatus 10 through an opening 10A thereon.

Figure 3:
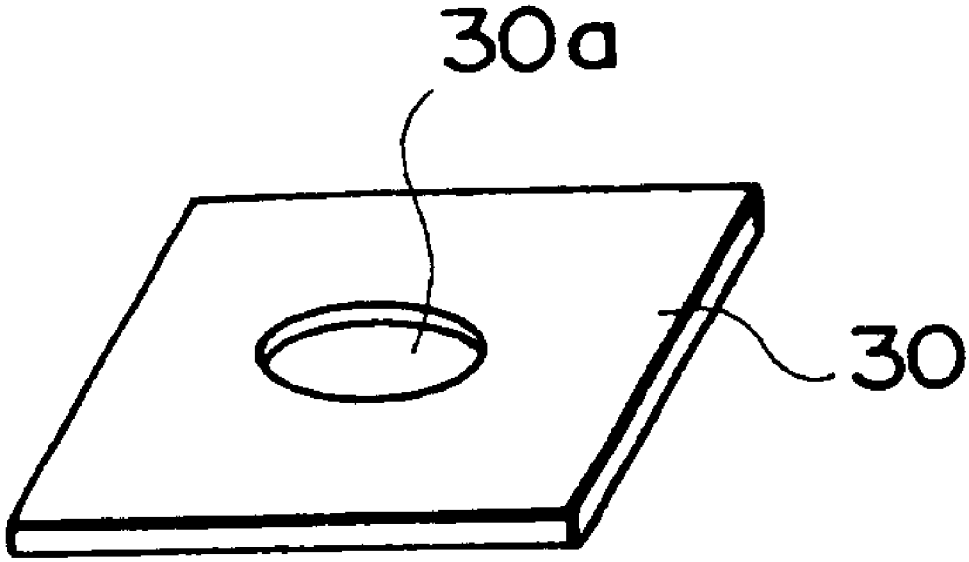
FIG. 3 is a perspective view of a slide contained in the slide pack to be unwrapped by the unwrapping apparatus.
Figure 4A:
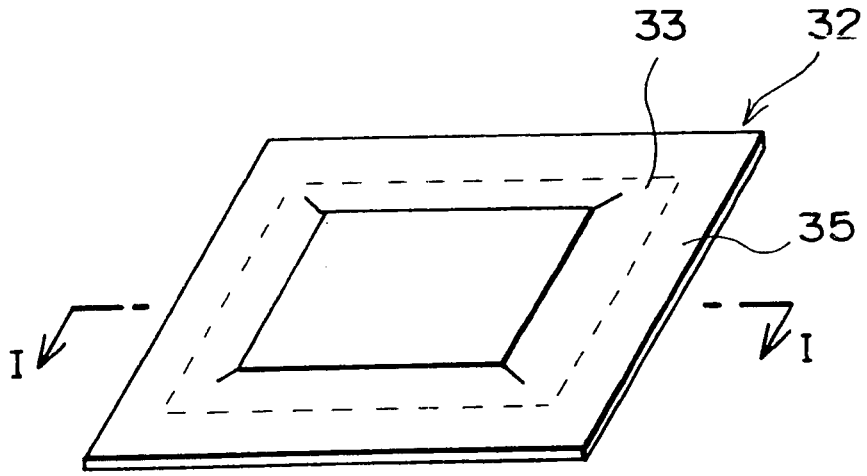
FIGS. 4A and 4B show the structure of the slide pack to be unwrapped by the unwrapping apparatus.
Figure 4B:
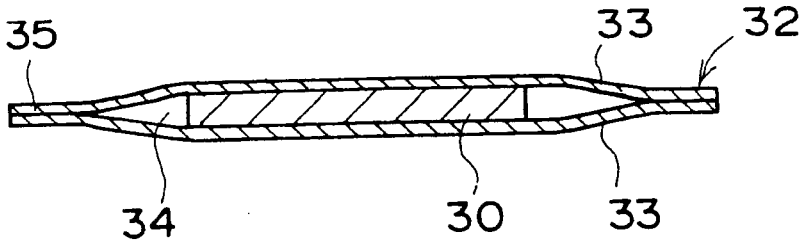

FIG. 3 is a perspective view of a slide contained in the slide pack to be unwrapped by the unwrapping apparatus 10. FIG. 4A is a perspective view of the slide pack before being unwrapped, and FIG. 4B is a sectional view thereof along the line I—I in FIG. 4A. As shown in FIG. 3, the slide 30 has a mount of a rectangular shape, and a dripping hole 30*a* is opened on the rectangular mount. In the present embodiment, blood plasma is dripped into the dripping hole 30*a* for analysis. In addition, a bar code is provided on the opposite side of the slide 30 for identifying the content of the analysis etc. related with that slide 30. Preferable dimensions for the slide 30 are 24 mm in width, 28 mm in length and 1.4 mm in thickness. The slide pack 32 shown in FIGS.

4A and 4B is prepared by sandwiching the slide 30 with a pair of wrapping sheets 33 (e.g., plastic films each laminated with a metal lamina), and forming a sealed portion 35 around an unsealed space 34 while suitably securing the unsealed space 34. In such a manner, the slide 30 is wrapped tightly with the wrapping sheets 33. In the case where the plastic film having the thickness of 0.05 mm is used as the wrapping sheet 33 together with the slide 30 having the above dimensions, dimensions of the slide pack 32 would be 46 mm in width and 50 mm in length. Then, a plurality of slide packs 32 are packed together in an outer package 42 before being shipped to the examiner. Each of the package cartridges 2 in the present embodiment is capable of housing all slide packs 32 contained in a single outer package 42 without manually unpacking the outer package 42.

Again in FIG. 2, a base plate 41 of the housing portion 3 is provided with a plurality of openings (not shown). Positions of the openings on the base plate 41 correspond to the positions of the package cartridges 2. In addition, a cut-off portion 42*a* is provided at the bottom of each outer package 42 for letting out the slide pack 32. Therefore, a slide pack 32 can be taken out of each outer package 42 housed in any package cartridge 2 through the cut-off portion 42*a* and one of the openings on the base plate 41.

Provided under the base plate 41 is a pack taking portion 50 for taking the slide pack 32 out of a certain outer package 42 and transferring the slide pack 32 to the opening 10A of the unwrapping apparatus 10. The pack taking portion 50 includes a sucker 51 for catching a desired slide pack 32. The sucker 51 is activated by vacuuming means 59 connected thereto. A sucker holding portion 52 carrying the sucker 51 is provided with a screwed bore 52*a*, which is screwed together with a screwed rod 53 extending in the y-direction. Each end of the screwed rod 53 is supported by a supporting portion 54. A pulse motor 55 fixed on the supporting portion 54 revolves the screwed rod 53 to move the sucker holding portion 52 in the y-direction. There are actually two separated supporting portions 54 at both ends of the screwed rod 53, though only one of them appears in FIG. 2.

Each of the supporting portions 54 is provided with another screwed bore 54*a*. The screwed bores 54*a* are screwed together with screwed rods 56A and 56B, respectively. The screwed rods 56A and 56B extend in the x-direction, and are suitably spaced from each other to enable the sucker holding portion 52 to be moved freely under the base plate 41. One end of the screwed rod 56A is supported by a bearing 57A, and the other end is provided with a pulse motor 58A. Similarly, one end of the screwed rod 56B is supported by a bearing 57B, and the other end is provided with a pulse motor 58B. The pulse motors 58A and 58B are controlled so that the screwed rods 56A and 56B are revolved in a synchronized motion. Thus, the sucker holding portion 52 is moved properly in the x-direction. Accordingly, the sucker holding portion 52 can move freely on the x-y plane under the base plate 41.

Figure 5:
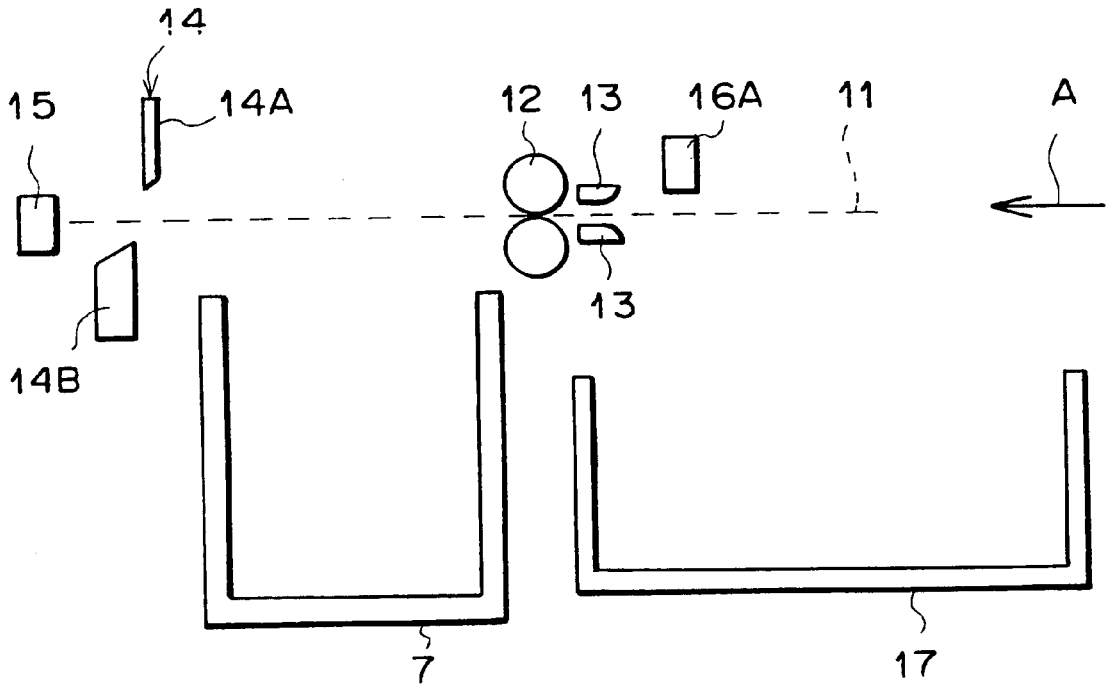
FIG. 5 shows the structure of the unwrapping apparatus according to the first embodiment of the present invention.

FIG. 5 shows the structure of the unwrapping apparatus 10. The unwrapping apparatus 10 includes paired metal rollers 12 (each having a diameter of 10 mm) driven in a synchronized motion. The paired metal rollers 12 are provided along a transferring path 11 for the slide pack 32. The paired metal rollers 12 may be replaced by paired resin rollers taking into consideration the friction between the rollers and the wrapping sheet 33. The slide pack 32 is first forwarded in the direction of the arrow A. Upper and lower halves of a squeezing member 13, which can be freely inserted into and retracted from the transferring path 11, are provided in front of the paired rollers 12 along the transferring path 11. Further, a reflection-type edge detector 16A is provided in front of the squeezing member 13 along the transferring path 11 for detecting the front edge of the slide pack 32. A cutter 14 is located behind the paired rollers 12 along the transferring path 11 for partially cutting the wrapping sheet 33 of the slide pack 32. The cutter 14 includes an upper blade 14A and a lower blade 14B each having a width suitable for cutting the wrapping sheet 33 only partially. Further, a contact-type abutment sensor 15 for recognizing the abutment of the front edge of the slide pack 32 thereon is provided behind the cutter 14 at the end of the transferring path 11. The position of the abutment sensor 15 is determined so that the front edge of the slide pack 32 abuts on the abutment sensor 15 when the rear edge of the slide pack 32 comes right between the paired rollers 12. In addition, the position of the cutter 14 is determined so that the cutter 14 becomes capable of cutting the unsealed space 34 when the rear edge of the slide pack 32 is held right between the paired rollers 12. The blade thickness of the lower blade 14B is larger than the blade thickness of the upper blade 14A.

Located behind the paired rollers 12 and under the transferring path 11 is the cartridge 7 for housing in a desired order a plurality of slides 30 each obtained from a slide pack 32. On the other hand, located in front of the paired rollers 12 and under the transferring path 11 is the disposal bin 17 used for temporarily storing the wrapping sheet 33 removed from the slide 30.

FIGS. 6A to 6D illustrate the structure of a roller unit 18 for driving and moving the paired rollers 12, wherein FIG. 6A is a plane view, FIG. 6B a side elevation, and FIGS. 6C and 6D are figures for illustrating the operation thereof. As shown in FIGS. 6A and 6B, each of the rollers 12A and 12B constituting the paired rollers 12 is respectively provided with a gear 19A or 19B, engaging with each other, at one end thereof. The rotation shafts of the rollers 12A and 12B are supported by supporting members 20 and 21. Each of shaft supporting holes 20A and 21A has an elongated shape to enable upward movement of the roller 12A with respect to the roller 12B. A motor 23 fixed to the supporting member 20 is connected to the rotation shaft of the roller 12B. Because of the engagement between the gears 19A and 19B, the rollers 12A and 12B move in a synchronized motion when the motor 23 drives the roller 12B. Connected to the motor 23 is an ammeter 24 for measuring driving current of the motor 23.

Further, each of the supporting members 20 and 21 is provided with nip pressure altering means 27 for altering nip pressure applied to the slide pack 32 by the roller 12A. The nip pressure altering means 27 includes an actuator 25 and a spring 26. When the actuator 25 is retracted, as shown in FIG. 6C, the spring 26 will stretch and the nip pressure applied by the paired rollers 12 will decrease. On the other hand, when the actuator 25 is extended, as shown in FIG. 6D, the spring 26 will shrink and the nip pressure applied by the paired rollers 12 will increase. Hereinafter, the nip pressure in the state shown in FIG. 6C is referred to as the first nip pressure, and the nip pressure in the state shown in FIG. 6D is referred to as the second nip pressure.

Figure 7:
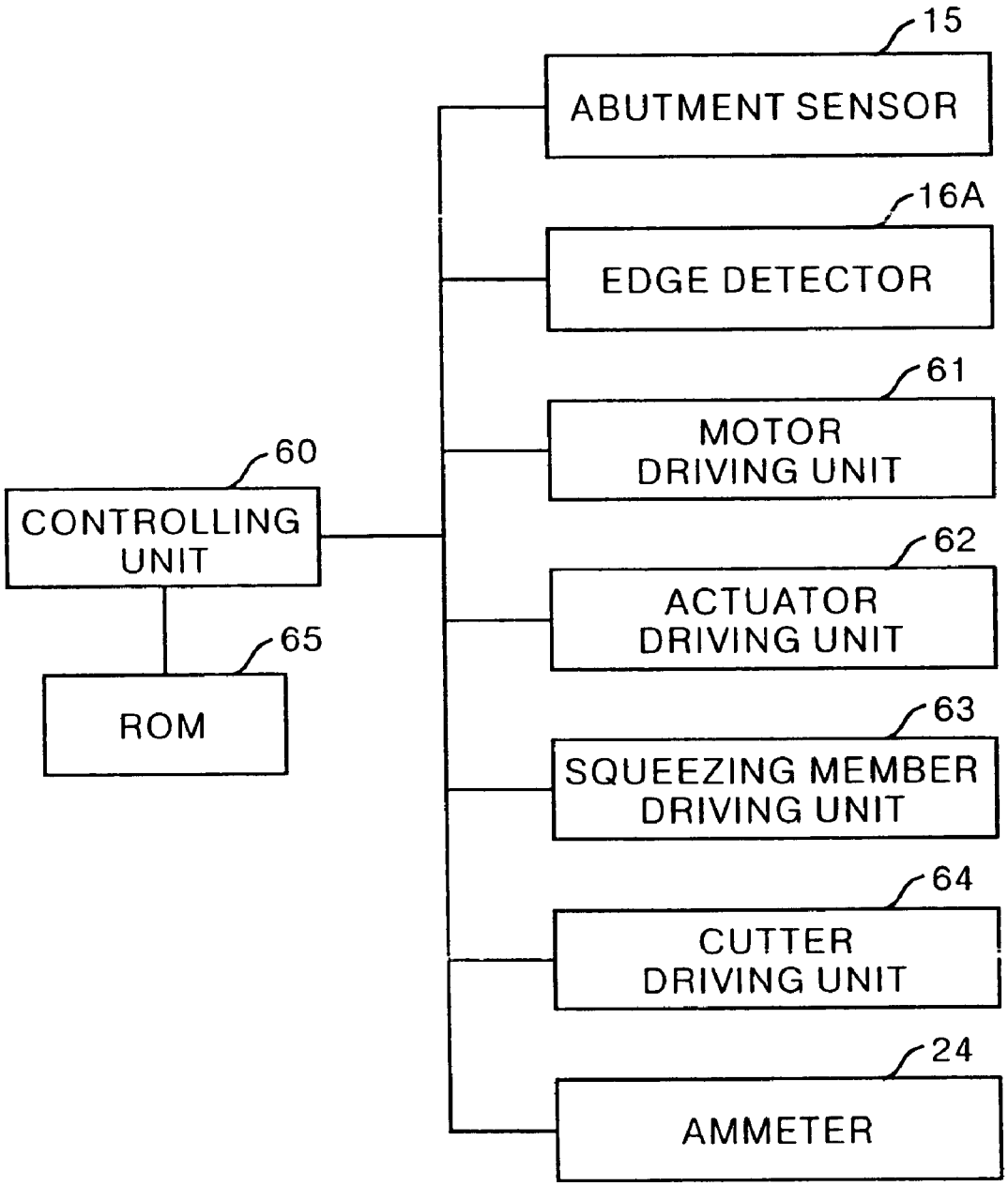
FIG. 7 is a block diagram schematically showing the structure of a controlling unit for controlling the operations of the unwrapping apparatus according to the first embodiment of the present invention.

FIG. 7 is a block diagram schematically showing the structure of a controlling unit 60 for controlling the operations of the unwrapping apparatus 10. As shown in FIG. 7, connected to the controlling unit 60 are the abutment sensor 15, the edge detector 16A, a motor driving unit 61 for driving the motor 23, an actuator driving unit 62 for driving the actuator 25 of the nip pressure altering means 27, a squeezing member driving unit 63 for driving the squeezing member 13 so as to be inserted into or retracted from the transferring path. 11, a cutter driving unit 64 for driving the cutter 14, the ammeter 24, and a ROM 65 containing a program for driving the controlling unit 60 in the manner described below.

Figure 8:
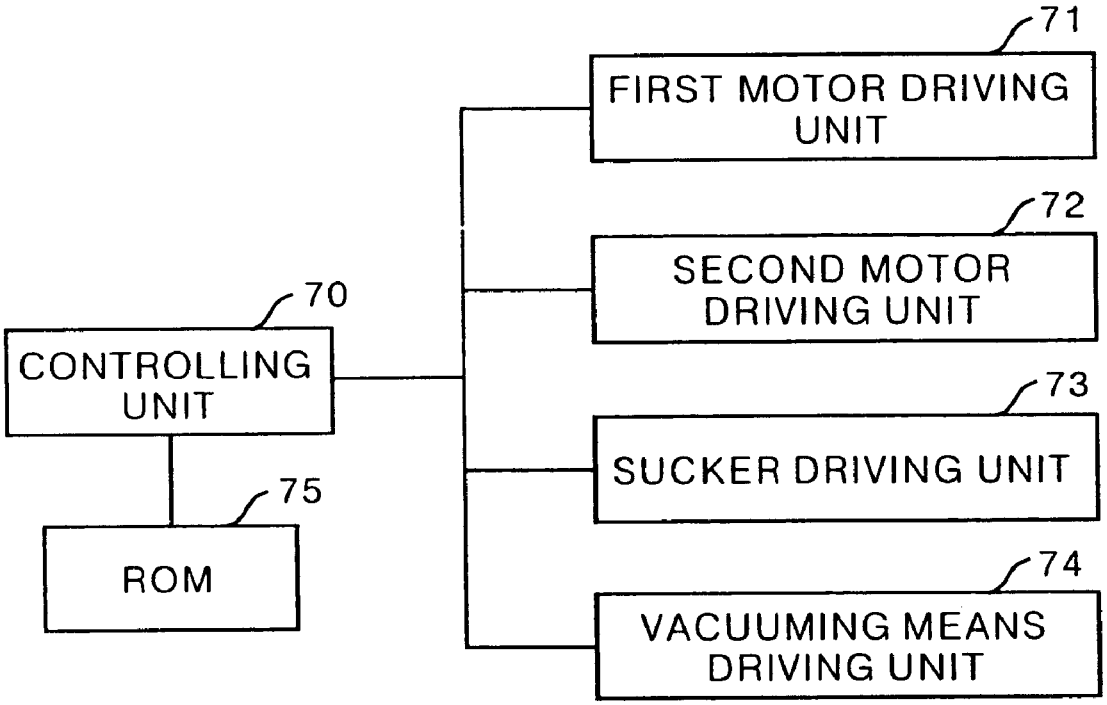
FIG. 8 is a block diagram schematically showing the structure of another controlling unit for controlling the operations of a pack taking portion.

FIG. 8 is a block diagram schematically showing the structure of another controlling unit 70 for controlling the operations of the pack taking portion 50. As shown in FIG. 8, connected to the controlling unit 70 are a first motor driving unit 71 for driving the pulse motor 55, a second motor driving unit 72 for driving the pulse motors 58A and 58B, a sucker driving unit 73 for driving the sucker holding portion 52 so that the sucker 51 thereon is moved in up and down directions, a vacuuming means driving unit 74 for driving the vacuuming means 59, and a ROM 75 containing a program for driving the controlling unit 70 in the manner described below.

Figure 9:
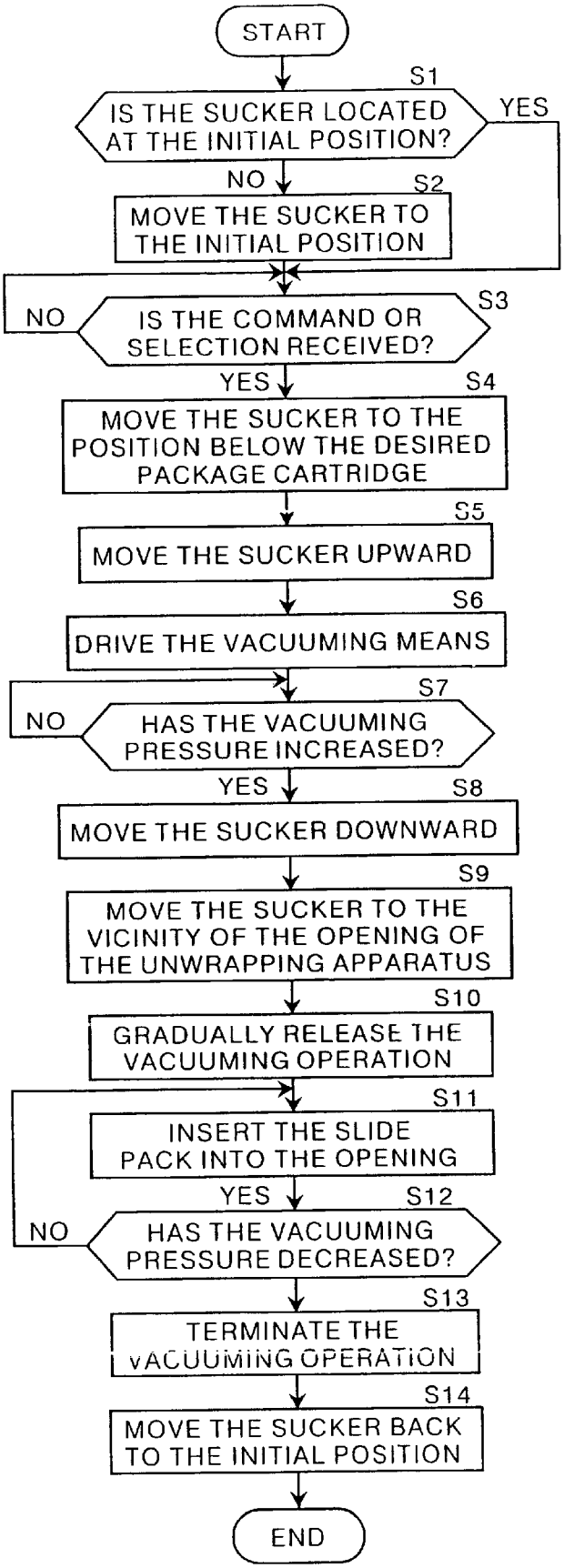
FIG. 9 is a flowchart showing the operation process of the selective unwrapping apparatus shown in FIG. 1.

Now, the operation of the selective unwrapping apparatus 1 of the present embodiment will be described in detail. FIG. 9 is a flowchart showing the operation process of the selective unwrapping apparatus 1 until the slide pack 32 is transferred to the unwrapping apparatus 10. First of all, whether or not the sucker 51 is appropriately located at a designated initial position thereof is checked (Step 1). If the sucker 51 is not located at the designated initial position, the first and second motor driving units 71 and 72 will drive the pulse motors 55, 58A and 58B to move the sucker 51 to the designated initial position (Step 2). In the next step, whether or not the command on selection of the slide pack 32 is received is checked (Step 3). The process proceeds to the next step (Step 4) when an operator inputs a command on desired selection of the slide pack 32 using the command keys 5 of the interface 4. In Step 4, the first and second motor driving units 71 and 72 drive the pulse motors 55, 58A and 58B to move the sucker 51 from the initial position thereof to the position below a certain package cartridge 2 where the desired slide pack 32 has been stored. The first and second motor driving units 71 and 72 may accomplish Step 4 by, for example, sending pulses to the pulse motors 55, 58A and 58B by the number required for moving the sucker 51 from the initial position thereof to a given coordinate point corresponding to the position of the desired package cartridge 2.

After the sucker 51 reaches the position below the desired package cartridge 2, the sucker driving unit 73 drives the sucker holding portion 52 so that the sucker 51 thereon is moved upward (Step 5). Concurrently, the vacuuming means driving unit 74 drives the vacuuming means 59 to activate the sucker 51 (Step 6). In the next step (Step 7), whether or not vacuuming pressure on the vacuuming means 59 has increased is judged. The increase of the vacuuming pressure indicates that the desired slide pack 32 is being sucked by the sucker 51. If the increase of the vacuuming pressure is not recognized, the vacuuming operation will be continued. If the increase of the vacuuming pressure is recognized, the sucker driving unit 73 will move the sucker 51 downward to take the desired slide pack 32 out of the outer package 42 stored in the package cartridge 2 (Step 8).

In the next step (Step 9), the first and second motor driving units 71 and 72 drive the pulse motors 55, 58A and 58B to move the sucker 51 to the vicinity of the opening 10A of the unwrapping apparatus 10, while continuing the vacuuming operation for making the sucker 51 suck the slide pack 32. Then, the vacuuming means driving unit 74 gradually releases the vacuuming operation (Step 10), and operation of the second motor driving unit 72 is also terminated. Accordingly, only the first motor driving unit 71 maintains its operation of driving the pulse motor 55 to insert the slide pack 32 into the opening 10A (Step 11). The slide pack 32 is separated from the sucker 51 when the paired rollers 12 in the unwrapping apparatus 10 catch the edge of the slide pack 32 and forward the slide pack 32 into the unwrapping apparatus 10. In the next step (Step 12), whether or not vacuuming pressure on the vacuuming means 59 has decreased to a certain level is judged. The decrease of the vacuuming pressure indicates that the slide pack 32 is now separated from the sucker 51. If the decrease of the vacuuming pressure is not recognized, the operation of inserting the slide pack 32 into the opening 10A will be continued. If the decrease of the vacuuming pressure is recognized, the vacuuming means driving unit 74 will completely terminate the vacuuming operation (Step 13) assuming that the slide pack 32 has successfully been forwarded. Finally, to end the process of transferring the slide pack 32 to the unwrapping apparatus 10, the first and second motor driving units 71 and 72 drive the pulse motors 55, 58A and 58B to move the sucker 51 back to the designated initial position thereof (Step 14).

Figure 10:
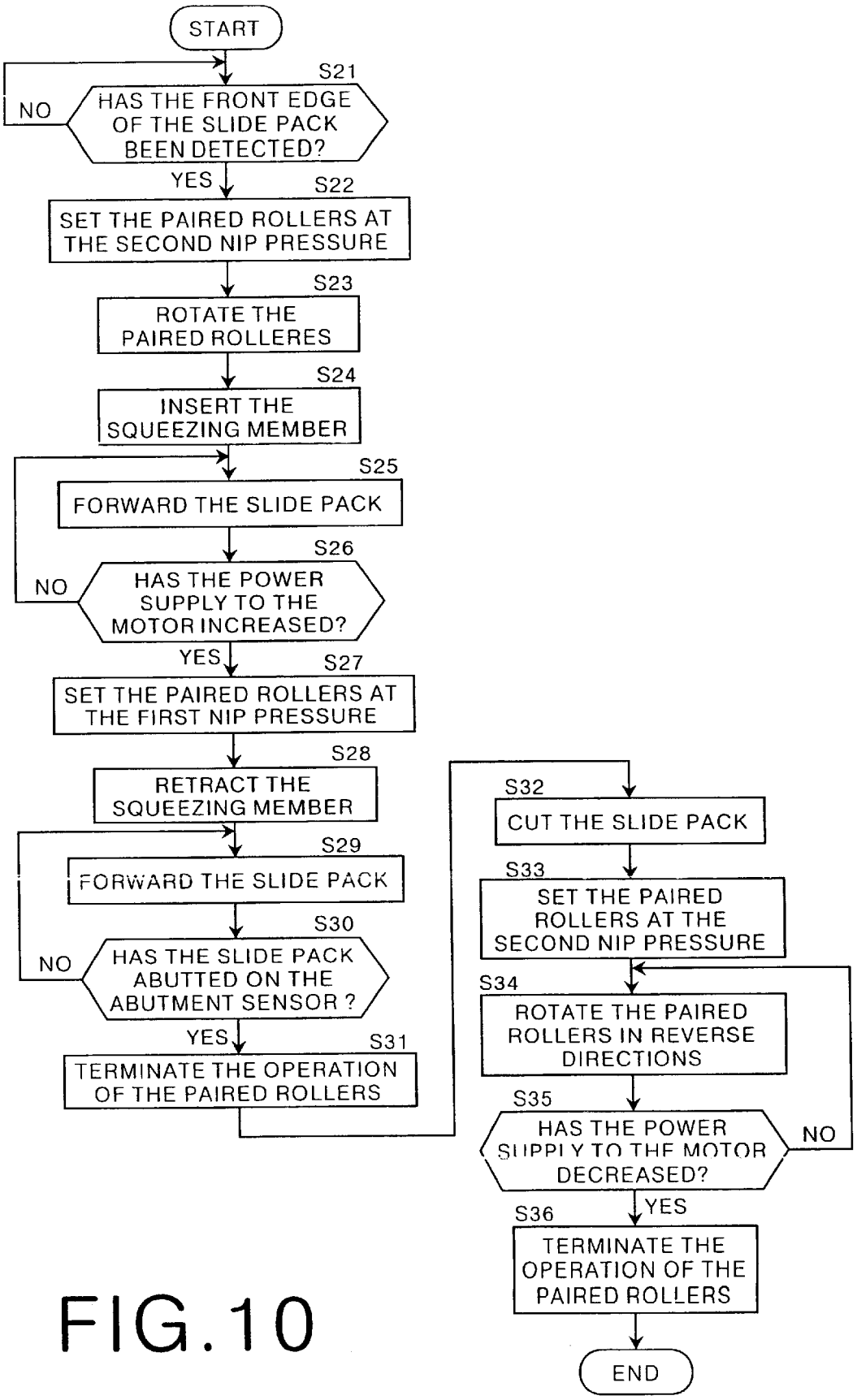
FIG. 10 is a flowchart showing the operation process of the unwrapping apparatus according to the first embodiment of the present invention.
Figure 11:
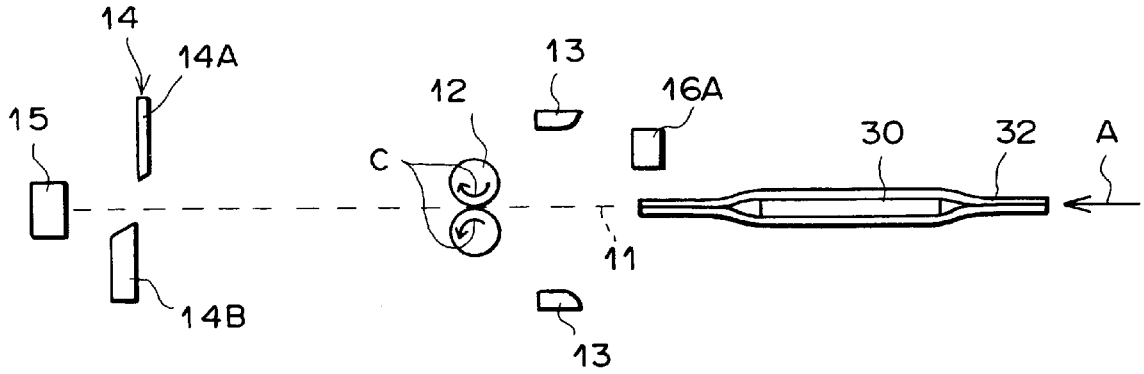
FIG. 11 illustrates a step of the operation process of the unwrapping apparatus according to the first embodiment of the present invention.
Figure 12:
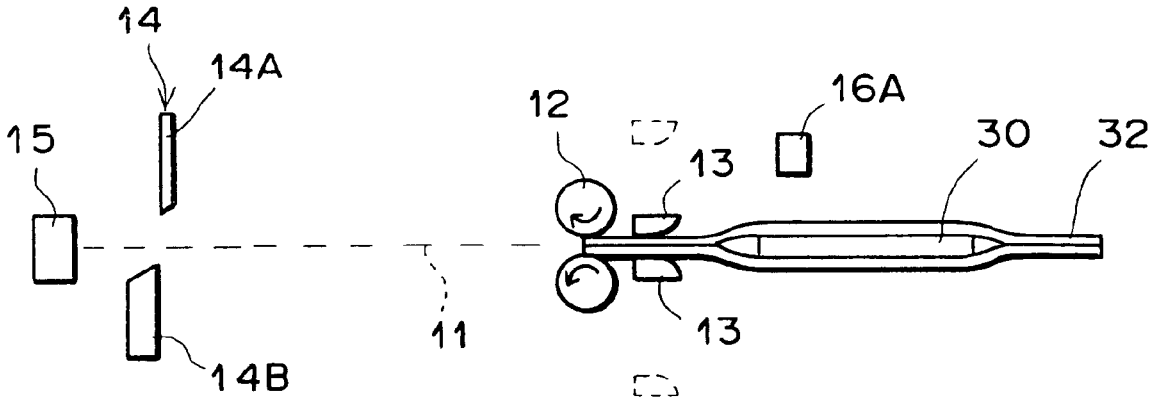
FIG. 12 illustrates another step of the operation process of the unwrapping apparatus according to the first embodiment of the present invention.

FIG. 10 is a flowchart showing the operation process of the unwrapping apparatus 10. The squeezing member 13 is assumed to be in the recessed state with respect to the transferring path 11 when starting the process of FIG. 10. First of all, whether or not the edge detector 16A has detected the front edge of the slide pack 32 is checked (Step 21). When the front edge were detected as shown in FIG. 11, the actuator driving unit 62 would extend the actuator 25 to cause the spring 26 to shrink until the nip pressure applied by the paired rollers 12 reaches the predetermined second nip pressure (Step 22). Then, the motor driving unit 61 drives the motor 23 to rotate the paired rollers 12 in the rotating directions C indicated by arrows in FIG. 11 (Step 23). Concurrently, the squeezing member driving unit 63 inserts the squeezing member 13 into the transferring path 11 (Step 24).

Figure 13:
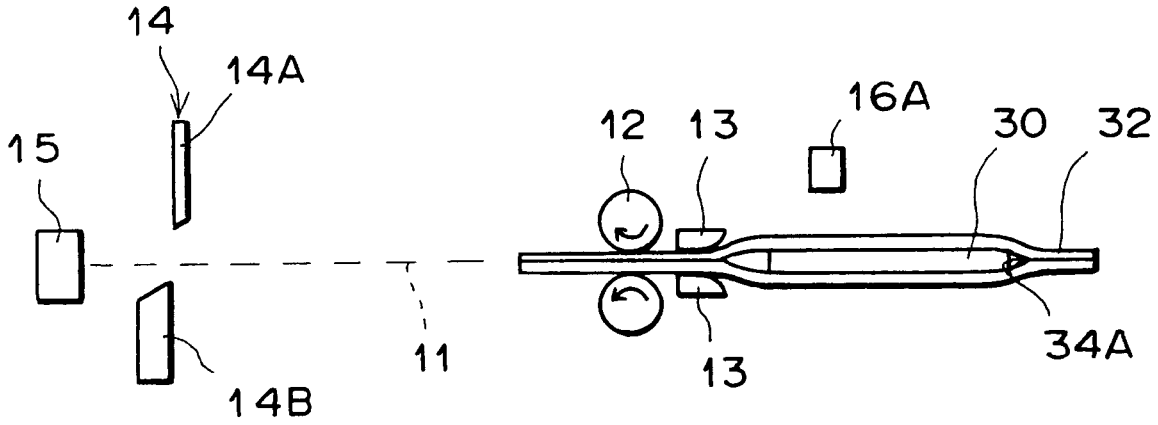
FIG. 13 illustrates another step of the operation process of the unwrapping apparatus according to the first embodiment of the present invention.
Figure 14:
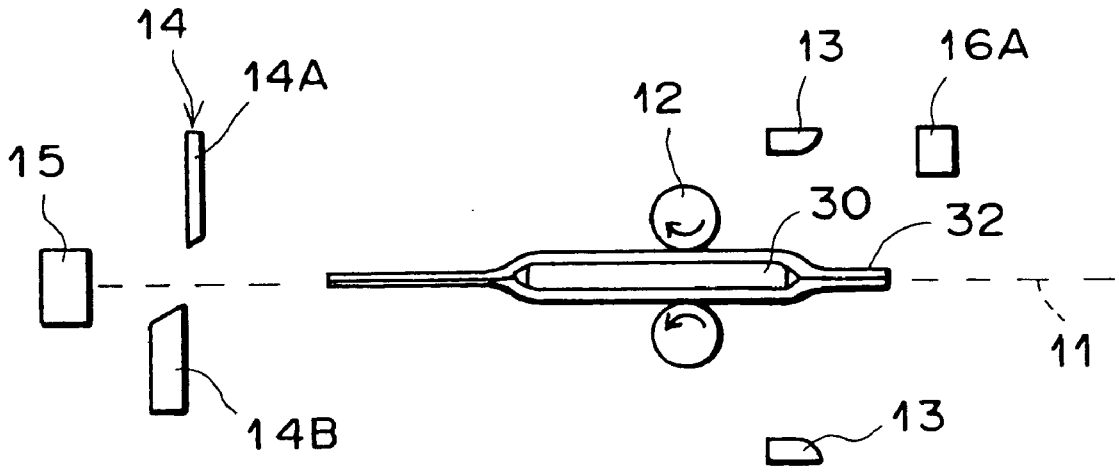
FIG. 14 illustrates another step of the operation process of the unwrapping apparatus according to the first embodiment of the present invention.

The slide pack 32 is initially forwarded in the direction indicated by an arrow A while being sucked by the sucker 51. The slide pack 32 is detached from the sucker 51 when the paired rollers 12 in the unwrapping apparatus 10 catch the front edge of the slide pack 32 and start forwarding the slide pack 32 along the transferring path 11 (Step 25). As the squeezing member 13 has already been inserted into the transferring path 11, the slide 30 in the slide pack 32 is squeezed back within the unsealed space 34 as the paired rollers 12 forward the slide pack 32. Accordingly, as shown in FIG. 13, a wide cut allowance is formed at the front edge of the slide pack 32. When the slide 30 abuts on the rear end 34A of the unsealed space 34, pressure applied by the paired rollers 12, and thus the power supply to the motor 23 for driving the paired rollers 12, will increase as the slide 30 can no longer be squeezed back within the unsealed space 34. Therefore, whether or not the power supply to the motor 23 has increased is checked in Step 26 by monitoring the power supply using the ammeter 24. If the increase of the power supply is detected, the actuator driving unit 62 will retract the actuator 25 to cause the spring 26 to stretch until the nip pressure applied by the paired rollers 12 reaches the predetermined first nip pressure (Step 27). In addition, the squeezing member driving unit 63 would retract the squeezing member 13 from the transferring path 11 (Step 28). Accordingly, the paired rollers 12 run on the portion of the slide pack 32 where the slide 30 resides, and further forward the slide pack 32 in the direction indicated by the arrow A. On the other hand, if the increase of the power supply is not detected in Step 26, the forwarding operation of Step 25 will be continued.

Figure 15:
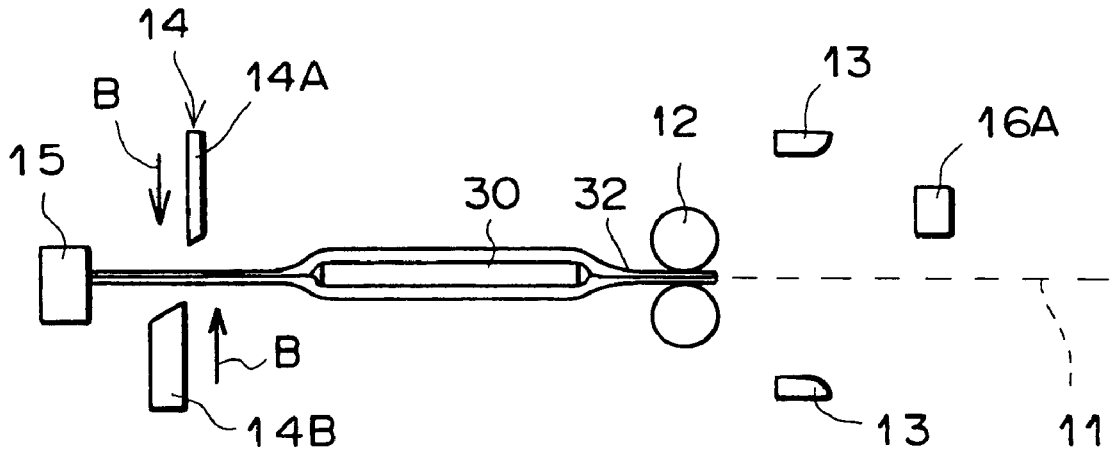
FIG. 15 illustrates another step of the operation process of the unwrapping apparatus according to the first embodiment of the present invention.

After an additional forwarding operation (Step 29), whether or not the front edge of the slide pack 32 has abutted on the abutment sensor 15 is checked (Step 30). If the abutment is not detected, the forwarding operation of Step 29 will be continued. If the abutment is detected, as shown in FIG. 15, the motor driving unit 63 will terminate the operation of motor 23 and thus the operation of the paired rollers 12 (Step 31). Then, the cutter 14 driven in the direction indicated by an arrow B by the cutter driving means 64 would partially cut the slide pack 32 (Step 32).

Figure 16:
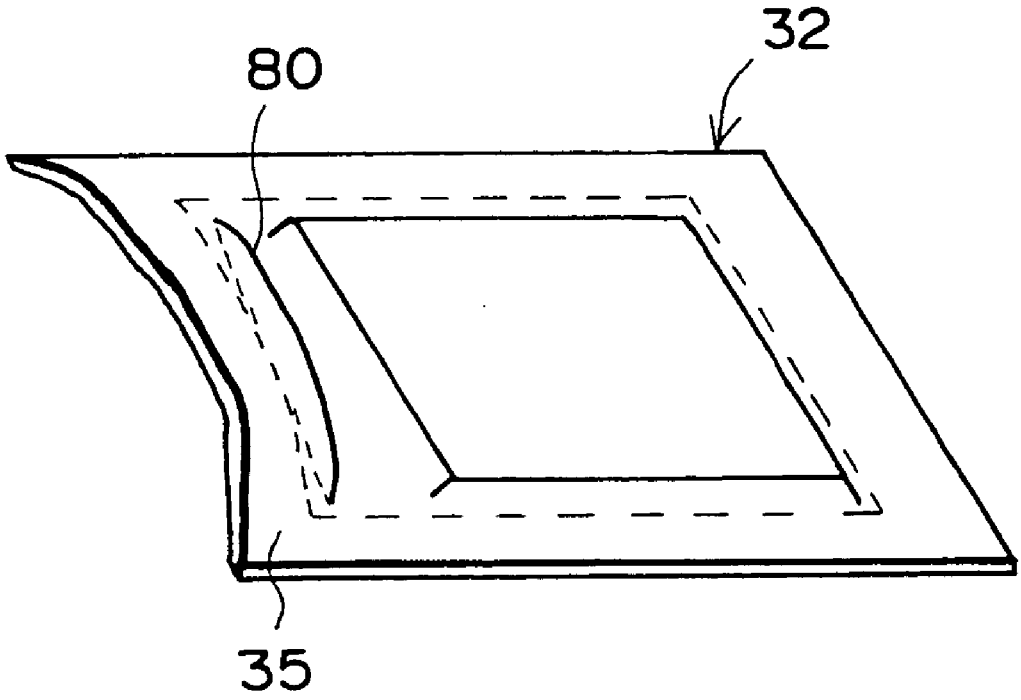
FIG. 16 is a perspective view showing a partially-cut slide pack.

FIG. 16 shows the partially-cut slide pack 32. As shown in FIG. 16, a slit 80 is formed in the vicinity of the sealed portion 35 at the front edge of the slide pack 32.

As the blade thickness of the lower blade 14B is larger than that of the upper blade 14A, the sealed portion 35 at the front edge of the slide pack 32 would form an up-winding arch after being cut with the cutter 14.

Figure 17:
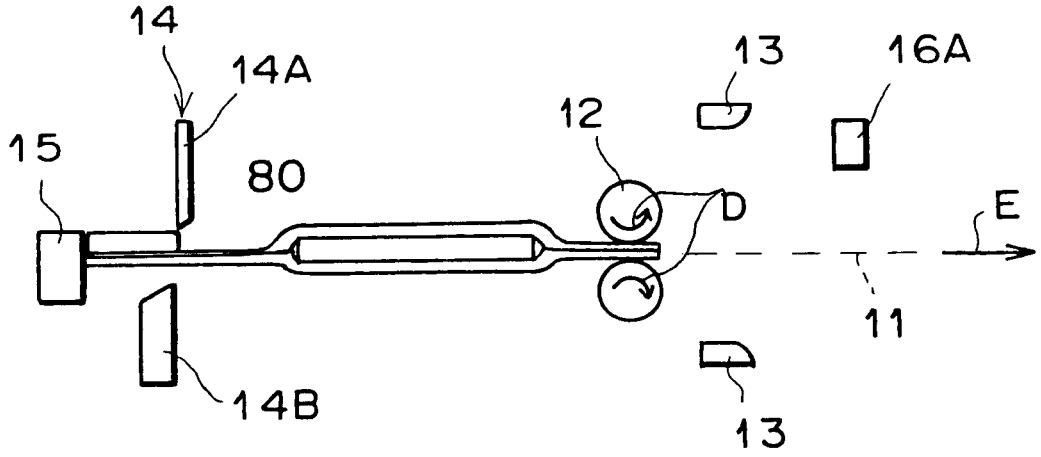
FIG. 17 illustrates another step of the operation process of the unwrapping apparatus according to the first embodiment of the present invention.
Figure 18:
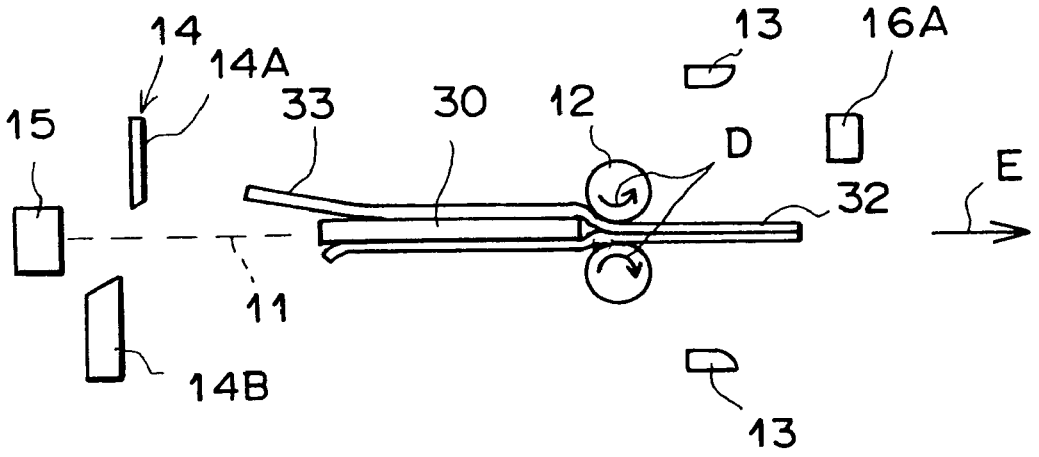
FIG. 18 illustrates another step of the operation process of the unwrapping apparatus according to the first embodiment of the present invention.

After the formation of the slit 80, the actuator driving unit 62 extends the actuator 25 to cause the spring 26 to shrink until the nip pressure applied by the paired rollers 12 reaches the predetermined second nip pressure as shown in FIG. 6D (Step 33). Then, the motor driving unit 61 drives the motor 23 in the reverse direction so that the paired rollers 12 rotate in the reverse directions indicated by arrows D in FIG. 17 (Step 34). Accordingly, the slide pack 32 is transferred backward along the transferring path 11 in the direction indicated by an arrow E. Because the spacing between the paired rollers 12 is too narrow to catch the slide 30, the slide 30 is gradually squeezed out of the slide pack 32 from the slit 80 as the slide pack 32 is transferred backward, as shown in FIG. 18.

Figure 19:
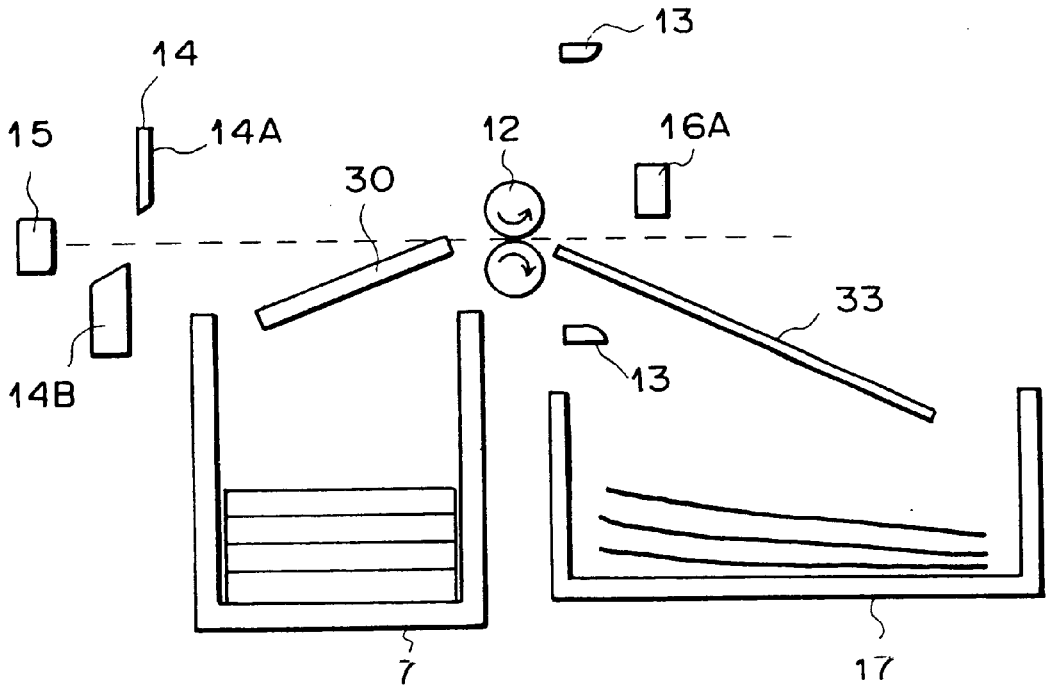
FIG. 19 illustrates another step of the operation process of the unwrapping apparatus according to the first embodiment of the present invention.

After further rotation of the paired rollers 12, the slide 30 would be completely separated from the wrapping sheet 33 as shown in FIG. 19. As shown in FIG. 19, the slide 30 would be housed in order in the cartridge 7 together with several other slides, and the wrapping sheet 33 would be temporarily stored in the disposal bin 17.

When the wrapping sheet 33 separated from the slide 30 is discarded into the disposal bin 17, the pressure applied by the paired rollers 12 and thus the power supply to the motor 23 for driving the paired rollers 12 will decrease. Therefore, when the decrease of the power supply to the motor 23 is detected by the ammeter 24 (Step 35), the motor driving unit 61 will terminate the operation of the motor 23 and thus the operation of the paired rollers 12 (Step 36) to end the entire operation shown in FIG. 10.

As described so far, the slide pack 32 can be automatically unwrapped to separate the slide 30 therein from the wrapping sheet 33 by using the unwrapping apparatus according to the present embodiment. In addition, as the slide pack 32 is cut only partially as shown in FIG. 16, the wrapping sheet 33 can keep the united form which is easy to handle, even after the cutting process. What makes the handling of the wrapping sheet 33 still easier is the reduced bulk thereof, realized by the paired rollers 12 which transfers the separated wrapping sheet 33 backward while pressing it.

Although the squeezing member 13 is utilized in the above embodiment to squeeze the slide 30 backward within the unsealed space 34 in the slide pack 32, the function of the squeezing member 13 may be incorporated into the paired rollers 12.

Figure 20:
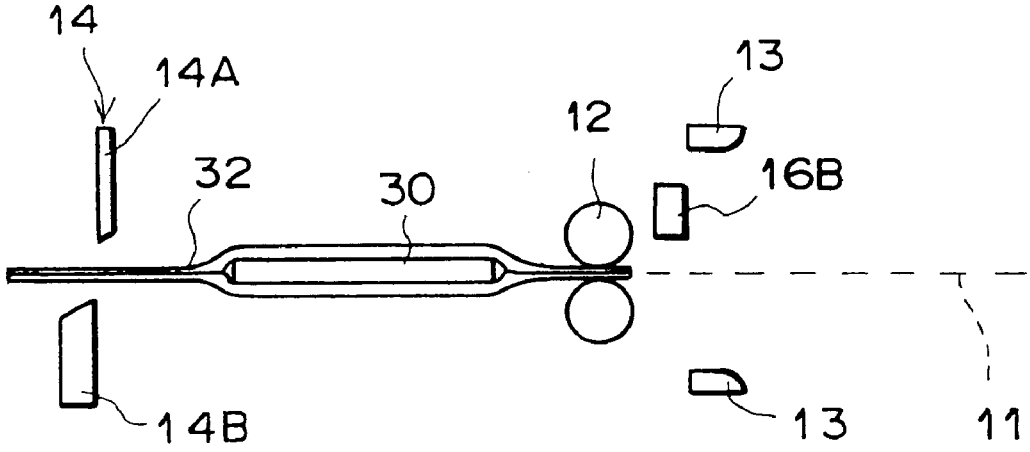
FIG. 20 illustrates another mechanism for terminating the operation of the paired rollers.

In addition, although the operation of the paired rollers 12 is terminated in Step 31 in FIG. 10 using the abutment sensor 15, a reflection-type edge detector 16B for detecting the rear edge of the slide pack 32 may be used instead of the abutment sensor 15. In that case, the edge detector 16B is located at a predetermined position on the transferring path 11 in front of the paired rollers 12 as shown in FIG. 20, and the operation of the paired rollers 12 is terminated when the rear edge of the slide pack 32 completely passes below the edge detector 16B. The position of the edge detector 16B is predetermined so that the rear edge of the slide pack 32 completely passes below the edge detector 16B when the unsealed space 34 in the vicinity of the sealed portion 15, as shown in FIG. 16, comes to the cutting position of the cutter 14. Otherwise, a reflection-type sensor for detecting the front edge of the slide pack may be used in place of the abutment sensor 15.

Figure 21:
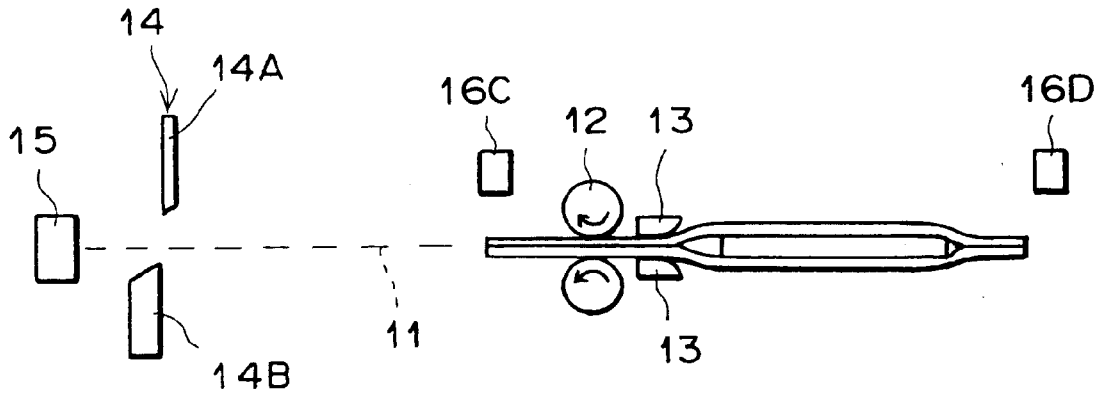
FIG. 21 illustrates another form of the squeezing operation.

Further, although whether or not the slide 30 in the slide pack 32 has abutted on the rear end 34A of the unsealed space 34 is determined by detecting the increase of the power supply to the motor 23 in Step 26 in the above embodiment, it may be determined instead by detecting the front edge of the slide pack 32 using a reflection-type edge detector 16C provided at a predetermined position on the transferring path 11 behind the paired rollers 12 as shown in FIG. 21. Instead, a reflection-type edge detector 16D for detecting the rear edge of the slide pack 32 may be provided as shown in FIG. 21. In the latter case, abutment of the slide 30 on the rear end 34A of the unsealed space 34 is recognized when the rear edge of the slide pack 32 completely passes below the edge detector 16D. The positions of the edge detectors 16C and 16D are determined so that the front edge and the rear edge of the slide pack 32 are aligned with the respective positions when the slide pack 32 is completely squeezed back by the squeezing member 13.

In addition, although the sealed portion 35 in the above embodiment has a predetermined width on all of the four sides of the wrapping sheet 33 as shown in FIGS. 4A and 4B, only the very edges of the wrapping sheet 33 may sufficiently form the sealed portion 35. Otherwise, the wrapping sheet 33 may have a bag-like form, i.e., the form having three of the four side sealed only on edges, so that a sealed portion 35 having a predetermined width is formed on only one side after inserting the slide 30 into the bag-like wrapping sheet 33.

Figure 22:
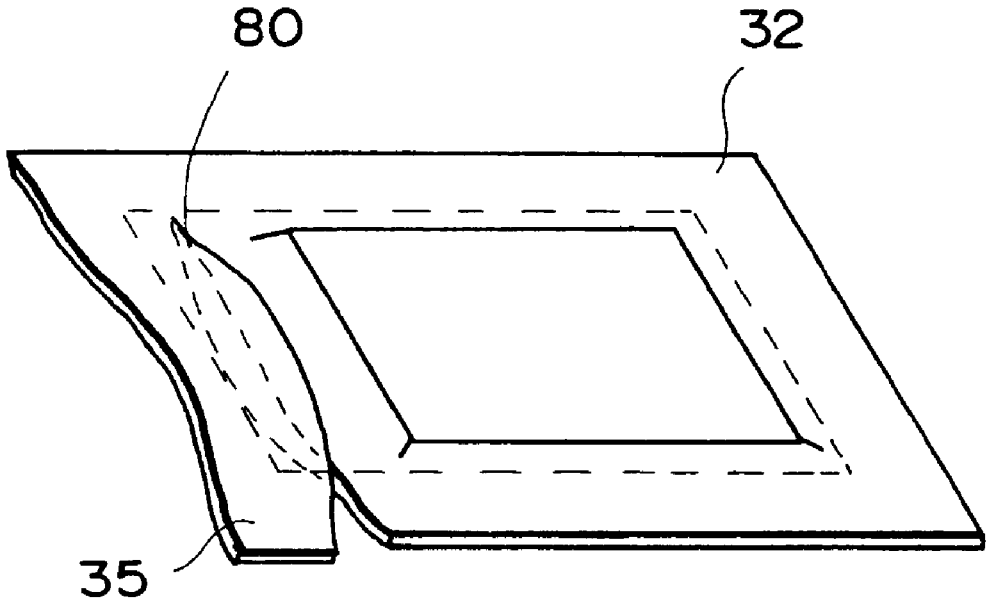
FIG. 22 is a perspective view showing a slide pack cut in a manner different from FIG. 16.
Figure 23:
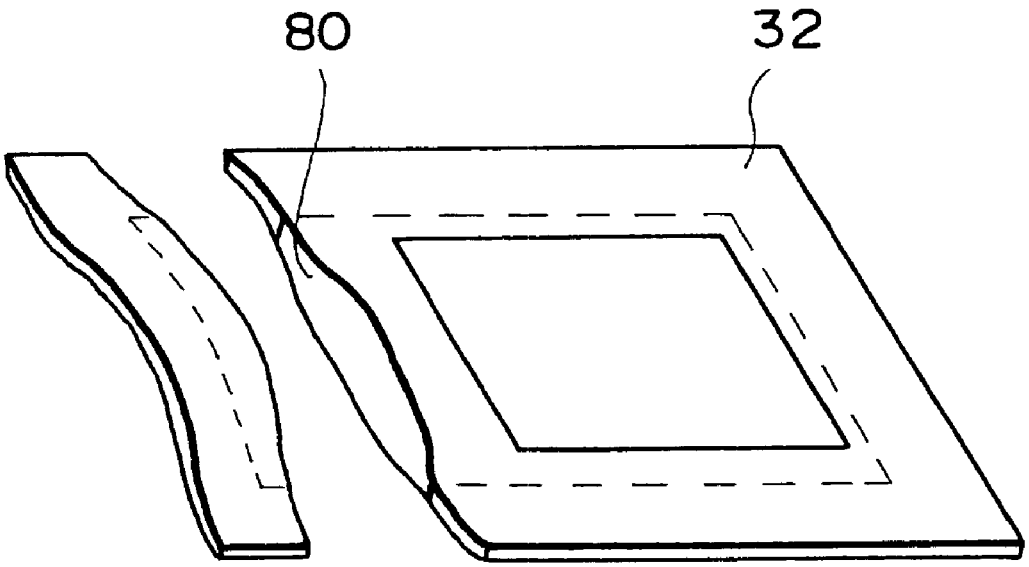
FIG. 23 is a perspective view showing a slide pack cut in a manner different from FIGS. 16 and 23.

Further, although the length of the slit 80 is limited to the width of the unsealed space 34 as shown in FIG. 16 in the above embodiment, the slit may be formed from one side of the slide pack 32 as shown in FIG. 22. Otherwise, the slit 80 may range over the entire width of the slide pack 32. In that case, a cut-off piece which is not held between the paired rollers 12 must be separately handled for disposal.

In addition, although the paired rollers 12 are activated after the edge detector 16A detects the front edge of the slide pack 32 in the above embodiment, the paired rollers 12 may be in the active state throughout the process requiring no edge detector.

Further, although the vacuuming operation of the vacuuming means 59 is terminated when the decrease of the vacuuming pressure is detected in the above embodiment, it may instead be terminated by checking whether or not the front edge of the slide pack 32 is caught between the paired rollers 12.

In addition, although the nip pressure applied by the paired rollers 12 is set at the second nip pressure in both Step 22 and Step 33 in the above embodiment, Step 22 and Step 33 may employ nip pressures different from each other. For example, Step 33 may employ a nip pressure which is different from the second nip pressure but is sufficient to squeeze the slide 30 out of the slit 80, while using the second nip pressure in Step 22. Otherwise, Step 22 may employ a nip pressure which is different from the second nip pressure but is sufficient to cause the squeezing member 13 to squeeze the slide 30 backward, while using the second nip pressure in Step 33.

Further, although the nip pressure applied by the paired rollers 12 is altered in the above embodiment using the nip pressure altering means 27, such altering of the nip pressure is unnecessary if the paired rollers 12 are capable of running on the portion of the slide pack 32 where the slide 30 resides and of separating the slide 30 from the wrapping sheet 33 under a single nip pressure.

In addition, although the cut allowance is formed by squeezing the slide 30 in the slide pack 32 back to the rear end 34A of the unsealed space 34 in Steps 22 to 26 in the above embodiment, the slide pack 32 may be cut by the cutter 14 without going through Steps 22 to 26 (i.e., without using the squeezing member 13) in the case where the unsealed space 34 has a sufficient margin or where the slide 30 has been offset in advance toward the rear end 34A.

Figure 24:
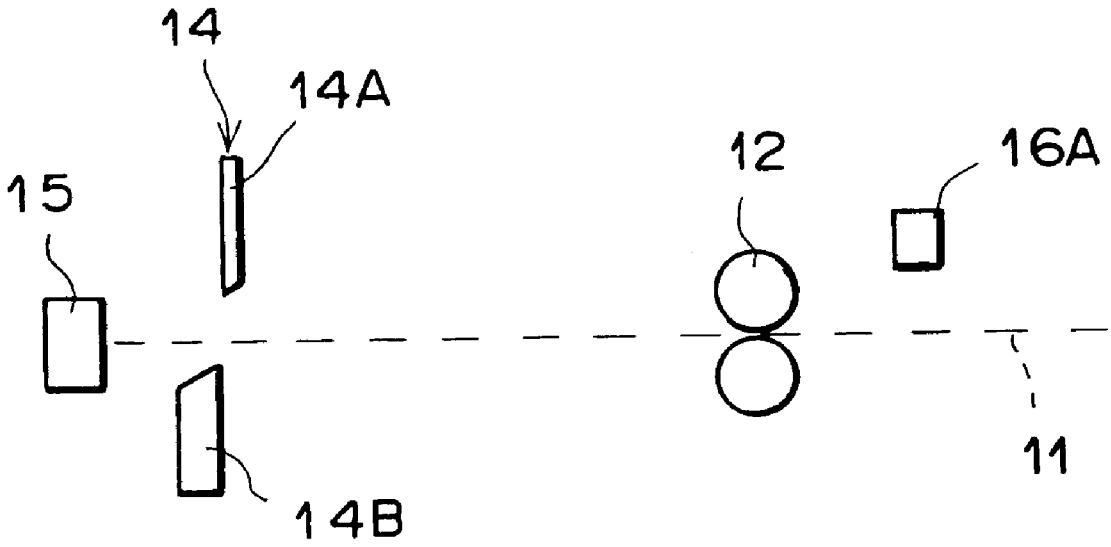
FIG. 24 shows the structure of an unwrapping apparatus according to the second embodiment of the present invention.

Now, the second embodiment of the present invention employing no squeezing member will be described. FIG. 24 illustrates the structure of an unwrapping apparatus according to the second embodiment of the present invention. Each component in FIG. 24 functions in the same way as the corresponding component having the same reference number in FIG. 5. As is clear from FIG. 24, the unwrapping apparatus according to the present embodiment comprises paired rollers 12, a cutter 14, an abutment sensor 15 and an edge detector 16A.

Figure 25:
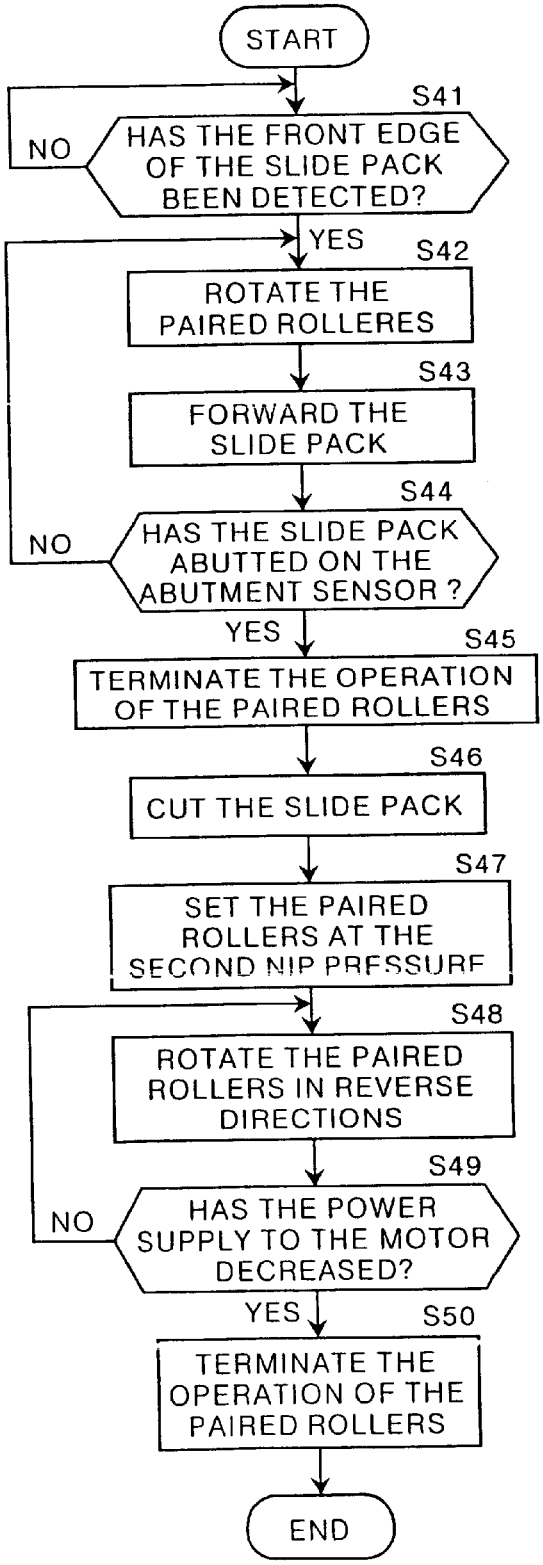
FIG. 25 is a flowchart showing the operation process of the unwrapping apparatus according to the second embodiment of the present invention.
Figure 26:
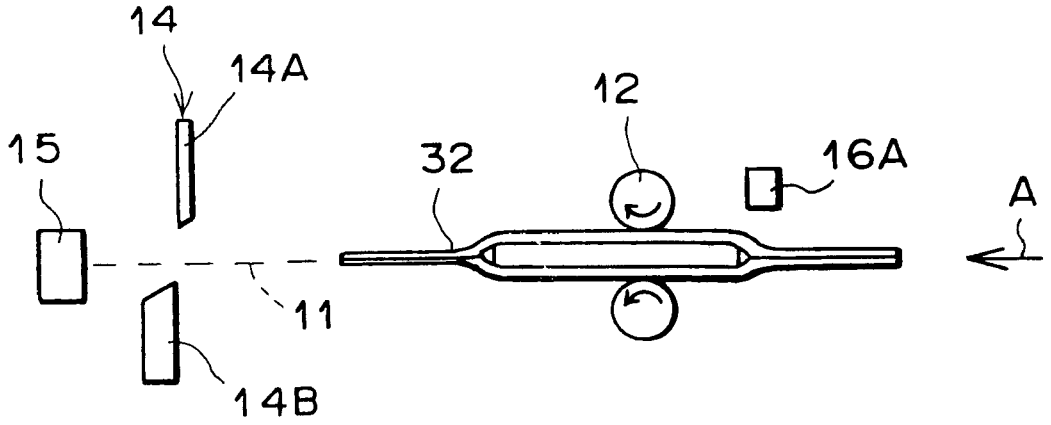
FIG. 26 illustrates a step of the operation process of the unwrapping apparatus according to the second embodiment of the present invention.

Now, the operation process of the unwrapping apparatus of the present embodiment will be described in detail with reference to a flowchart shown in FIG. 25. It is assumed that initial nip pressure applied to the slide pack 32 by the paired rollers 12 has been settled at the first nip pressure. First of all, whether or not the edge detector 16A has detected the front edge of a slide pack 32 is checked (Step 41). When the front edge is detected by the edge detector 16A, the motor driving unit 61 drives the motor 23 to rotate the paired rollers 12 in the same manner as the first embodiment (Step 42). Then, the slide pack 32 is forwarded along the transferring path 11 while being held between the paired rollers 12 (Step 43).

As the nip pressure applied by the paired rollers 12 has already been set at the first nip pressure, the paired rollers 12 naturally run on the portion of the slide pack 32 where the slide 30 resides as the slide pack 32 is forwarded, and further forward the slide pack 32 in the direction indicated by the arrow A. After an additional forwarding operation, whether or not the front edge of the slide pack 32 has abutted on the abutment sensor 15 is checked (Step 44). Step 44 may be replaced by a step of detecting the rear edge of the slide pack 32 using an edge detector. If the abutment is not detected in Step 44, the forwarding operation will be continued. If the abutment is detected, the motor driving unit 63 will terminate the operation of motor 23 and thus the operation of the paired rollers 12 (Step 45). Then, the cutter 14 driven by the cutter driving means 64 would partially cut the slide pack 32 (Step 46). After formation of the slit 80, the actuator driving unit 62 extends the actuator 25 to cause the spring 26 to contract until the nip pressure applied by the paired rollers 12 reaches the predetermined second nip pressure as shown in FIG. 6D (Step 47). Then, Steps 48 to 50, which are identical to Steps 34 to 36 in FIG. 10, are carried out to separate the slide 30 from the wrapping sheet 33.

Although both the first and second embodiments described above relate to an unwrapping apparatus for unwrapping the slide pack 32 containing the slide 30 for chemical analysis, the present invention is applicable to any kind of package containing a solid object wrapped with a wrapping sheet.

What is claimed is:

1. An unwrapping apparatus for unwrapping a package containing a solid object tightly wrapped with a wrapping sheet, said package including an unsealed space where the solid object is contained and a sealed portion surrounding the unsealed space, comprising paired rollers rotatable so that the package caught between the paired rollers is transferred along a predetermined transferring path, a cutter located behind the paired rollers along the transferring path for making a slit on the unsealed space at a position near the front edge of the package, and controlling means for controlling operations of the paired rollers and the cutter by setting nip pressure applied to the package by the paired rollers at a pressure suitable both for transferring the package containing the solid object and for transferring the wrapping sheet without the solid object, rotating the paired rollers in respective predetermined directions so that the package is forwarded along the predetermined transferring path, terminating rotation of the paired rollers when the rear edge of the package comes between the paired rollers, making a slit on the package, and rotating the paired rollers in the directions opposite to said predetermined directions so that only the wrapping sheet separated from the solid object is transferred back by the paired rollers.

2. An unwrapping apparatus for unwrapping a package containing a solid object tightly wrapped with a wrapping sheet, said package including an unsealed space where the solid object is contained and a sealed portion surrounding the unsealed space, comprising paired rollers rotatable so that the package caught between the paired rollers is transferred along a predetermined transferring path, nip pressure altering means for altering nip pressure applied to the package by the paired rollers, a cutter located behind the paired rollers along the transferring path for making a slit on the unsealed space at a position near the front edge of the package, and controlling means for controlling operations of the paired rollers, the nip pressure altering means and the cutter by setting the nip pressure applied by the paired rollers at a first nip pressure, rotating the paired rollers in respective predetermined directions so that the package is forwarded along the predetermined transferring path, terminating rotation of the paired rollers when the rear edge of the package comes between the paired rollers, making a slit on the package, setting the nip pressure applied by the paired roller at a second nip pressure which is larger than the first nip pressure, and rotating the paired roller in the directions opposite to said predetermined directions so that only the wrapping sheet separated from the solid object is transferred back by the paired rollers.

3. An unwrapping apparatus according to claim 2, further comprising edge detecting means for detecting the front edge of the package located in front of the paired rollers along the transferring path, wherein the controlling means further controls operations of the paired rollers by causing the paired rollers to begin the rotation in said predetermined directions after the front edge of the package is detected by the edge sensor.

4. An unwrapping apparatus according to claim 2, further comprising an object cartridge used for housing the solid object after being separated from the wrapping sheet and being located behind the paired rollers along the transferring path.

5. An unwrapping apparatus according to claim 2, further comprising a disposal bin used for temporarily storing the wrapping sheet removed from the solid object and being located in front of the paired rollers along the transferring path.

6. An unwrapping apparatus according to claim 4, further comprising a disposal bin used for temporarily storing the wrapping sheet removed from the solid object and being located in front of the paired rollers along the transferring path.

7. An unwrapping apparatus according to claim 2, wherein the slit formed by the cutter is shorter than the entire width of the package.

8. An unwrapping apparatus according to claim 2, further comprising shift detecting means for recognizing that the solid object has been sufficiently squeezed back to the rear end of the unsealed space in the package, wherein the controlling means further controls operations of the paired rollers, the nip pressure altering means and the shift detecting means by setting the nip pressure applied by the paired roller at a third nip pressure which is larger than the first nip pressure before setting the nip pressure at the first nip pressure, rotating the paired roller in said predetermined directions so that the package is forwarded along the predetermined transferring path, and changing the nip pressure applied by the paired rollers to the first nip pressure when the shift detecting means recognizes that the solid object has been sufficiently squeezed back to the rear end of the unsealed space in the package.

9. An unwrapping apparatus according to claim 8, further comprising edge detecting means for detecting the front edge of the package located in front of the paired rollers along the transferring path, wherein the controlling means further controls operations of the paired rollers by causing the paired rollers to begin the rotation in said predetermined directions after the front edge of the package is detected by the edge sensor.

10. An unwrapping apparatus according to claim 8, further comprising an object cartridge used for housing the solid object after being separated from the wrapping sheet and being located behind the paired rollers along the transferring path.

11. An unwrapping apparatus according to claim 8, further comprising a disposal bin used for temporarily storing the wrapping sheet removed from the solid object and being located in front of the paired rollers along the transferring path.

12. An unwrapping apparatus according to claim 10, further comprising a disposal bin used for temporarily storing the wrapping sheet removed from the solid object and being located in front of the paired rollers along the transferring path.

13. An unwrapping apparatus according to claim 8, wherein the slit formed by the cutter is shorter than the entire width of the package.

14. An unwrapping apparatus according to claim 8, further comprising a squeezing member located in front of the paired rollers along the transferring path in such a manner that the squeezing member can be freely inserted into and retracted from the transferring path, wherein the controlling means further controls operations of the squeezing member by inserting the squeezing member into the transferring path before forwarding the package under the third nip pressure, and retracting the squeezing member from the transferring path when the shift detecting means recognizes that the solid object has been sufficiently squeezed back to the rear end of the unsealed space of the package.

15. An unwrapping apparatus according to claim 14, further comprising edge detecting means for detecting the front edge of the package located in front of the paired rollers along the transferring path, wherein the controlling means further controls operations of the paired rollers by causing the paired rollers to begin the rotation in said predetermined directions after the front edge of the package is detected by the edge sensor.

16. An unwrapping apparatus according to claim 14, further comprising an object cartridge used for housing the solid object after being separated from the wrapping sheet and being located behind the paired rollers along the transferring path.

17. An unwrapping apparatus according to claim 14, further comprising a disposal bin used for temporarily storing the wrapping sheet removed from the solid object and being located in front of the paired rollers along the transferring path.

18. An unwrapping apparatus according to claim 16, further comprising a disposal bin used for temporarily storing the wrapping sheet removed from the solid object and being located in front of the paired rollers along the transferring path.

19. An unwrapping apparatus according to claim 14, wherein the slit formed by the cutter is shorter than the entire width of the package.

* * * * *